United States Patent [19]

Tsuchida et al.

[11] Patent Number: 4,807,692

[45] Date of Patent: Feb. 28, 1989

[54] MOLD APPARATUS FOR ENDLESS TRACK TYPE CONTINUOUS CASTING MACHINE

[75] Inventors: Yutaka Tsuchida, Yokosuka; Shuzo Takahashi, Yokohama; Shiro Osada, Yokohama; Nobuhisa Hasebe, Yokohama, all of Japan

[73] Assignees: Ishikawajima-Harima Jukogyo Kabushiki Kaisha; Nippon Kokan Kabushiki Kaisha, both of Japan

[21] Appl. No.: 84,860

[22] Filed: Aug. 13, 1987

[30] Foreign Application Priority Data

Aug. 15, 1986 [JP] Japan ..... 61-191523
Dec. 12, 1986 [JP] Japan ..... 61-296461

[51] Int. Cl.[4] ..... B22D 11/06; B22D 11/124

[52] U.S. Cl. ..... 164/430; 164/443

[58] Field of Search ..... 164/429, 430, 431, 433, 164/479, 485, 443

[56] References Cited

U.S. PATENT DOCUMENTS 2,752,649 7/1956 Hunter ..... 164/430
3,605,868 9/1971 Giadorou ..... 164/430

FOREIGN PATENT DOCUMENTS 59-215252 12/1984 Japan ..... 164/443

*Primary Examiner*—Kuang Y. Lin

[57] ABSTRACT

In a mold apparatus for an endless track type continuous casting machine of the type in which a plurality of cooling blocks are interconnected with each other in the form of an endless chain to assemble a cooling block chain which can define a straight wall; a pair of said cooling block chains are disposed such that the straight wall thereof define a mold; and the cooling block chains are moved in synchronism with the casting speed or rate, a plurality of cooling holes are extended through each cooling block in the direction perpendicular to the direction of the movement thereof and in parallel with the straight wall section thereof; one or more cooling water pipes are disposed along one side surface of said straight wall section of each cooling block chain and are provided with a plurality of nozzles in line with the cooling holes of the cooling blocks so that the cooling water is injected through the nozzles to their corresponding cooling holes of the cooling blocks which are moving, thereby cooling the cooling blocks in contact with a casting with the cooling water. Therefore, the cooling blocks can be cooled very effectively; a satisfactory shell growth rate can be attained; and break-out or the like can be avoided even when the cooling block chains are stopped in case of emergency.

6 Claims, 5 Drawing Sheets

MOLD APPARATUS FOR ENDLESS TRACK TYPE CONTINUOUS CASTING MACHINE

BACKGROUND OF THE INVENTION

The present invention relates to a mold apparatus for an endless track type continuous casting machine for continuously casting a thin casting.

There has been devised and demonstrated a continuous casting method for casting a thin casting of the type in which, as shown in FIG. 8, a plurality of cooling blocks 1 are interconnected with each other in the form of an endless track, thereby assemblying cooling block chains 2 and 3; the cooling block chains 2 and 3 are so disposed and driven that they define straight walls 4 over a predetermined distance and that the straight walls 4 are spaced apart from each other by a predetermined distance, thereby defining a mold 5; and the cooling block chains 2 and 3 are driven in synchronism with the casting speed of a casting 6 so that molten metal is cast while growing a shell over the surfaces of the cooling blocks 1.

One of the greatest problems encountered in the mold apparatus of the continuous casting machine of the type described is how to cool each cooling block and in general the mold 5 is defined by the cooling block chains. The opposite linear portions of the straight section is used as a cooling zone for cooling each cooling block.

However, in the above-mentioned cooling method, each cooling block is cooled only when it is not in contact with a casting so that a satisfactory growth of the shell which is determined by the thermal capacity of the cooling blocks cannot be obtained. Furthermore, when the driving of the cooling block chains 2 and 3 is interrupted in case of an emergency, it becomes impossible to cool a casting so that a break-out; that is, the flow of the interior molten metal resulting from the break of the shell occurs.

In view of the above, the present invention was made as has for its object to provide a mold apparatus for an endless track type continuous casting machine which has a remarkably high degree of cooling capacity and which can maintain the cooling function even when the cooling mold chains which define a mold are stopped in case of an emergency.

DETAILED DESCRIPTION OF THE PREFERRED EMBODIMENTS

Figure 1:
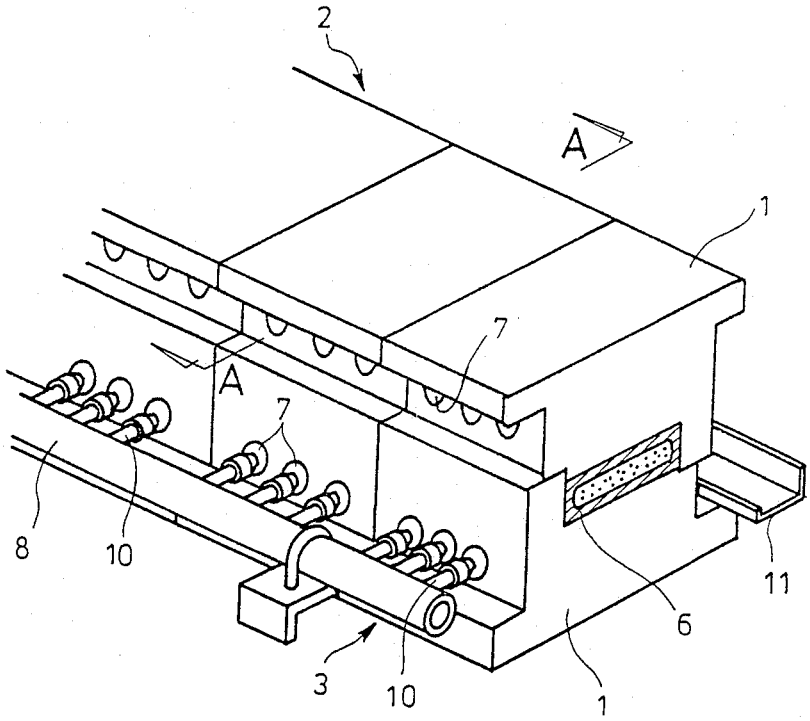
FIG. 1 is a partial perspective view of a preferred embodiment of the present invention.
Figure 2:
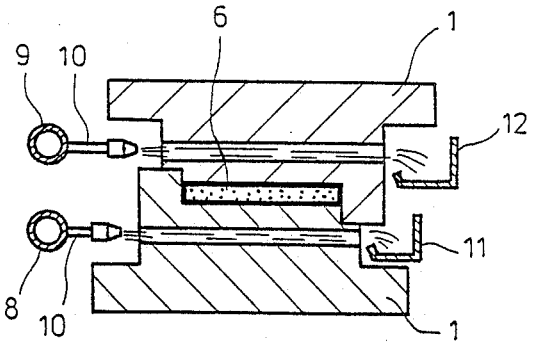
FIG. 2 is a sectional view taken along the line A—A of FIG. 1.

Referring first to FIGS. 1 and 2, a first embodiment of the present invention will be described. FIG. 1 shows partial portion of a mold.

Each cooling block 1 is formed with a plurality of through cooling holes extended perpendicular to the travel of the cooling block 1 and in parallel with the cooling surfaces thereof. Upper and lower cooling pipes 9 and 8 which are spaced apart from each other by a predetermined distance in the vertical direction are extended in parallel with one side surface of the upper and lower cooling block chains 2 and 3. (The upper cooling pipe 9 is not shown in FIG. 1.) The cooling pipes 8 and 9 are provided with a plurality of cooling water injection nozzles 10 such that the plane containing the axes of the cooling water injection nozzles 10 of each of the cooling pipes 8 and 9 is in coincidence with the plane containing the axes of the through cooling holes 7 of each block 1 of the upper and lower cooling block chains 2 and 3. Upper and lower trays 12 and 11 are extended in parallel with the other side surface of the cooling block chains 2 and 3 on the downstream sides of the through cooling holes 7.

In operation, the cooling water is forced to issue from each nozzle 10 against said one side surface defined by the upper and lower cooling block chains 2 and 3. Both the cooling block chains 2 and 3 are driven at a predetermined peripheral speed so that the through cooling holes 7 and the nozzles 10 are sequentially in line with each other so that the cooling water flows past the through cooling holes 7, cooling the walls thereof. The cooling water which is discharged from the cooling holes 7 is collected in the trays 11 and 12 and then returned to a cooling water storage (not shown).

According to the first embodiment, the cooling blocks 1 in contact with a casting 6 can be cooled with the cooling water so that a high degree of heat dissipation effect can be obtained and consequently the growth rate of the shell can be increased, thus increasing the casting speed of the casting 6.

In the first embodiment, solenoid-controlled valves may be inserted into the cooling pipes 8 and 9 so that the cooling water can be intermittently issued only when each nozzle 10 is in line with each through cooling hole 7.

Figure 3:
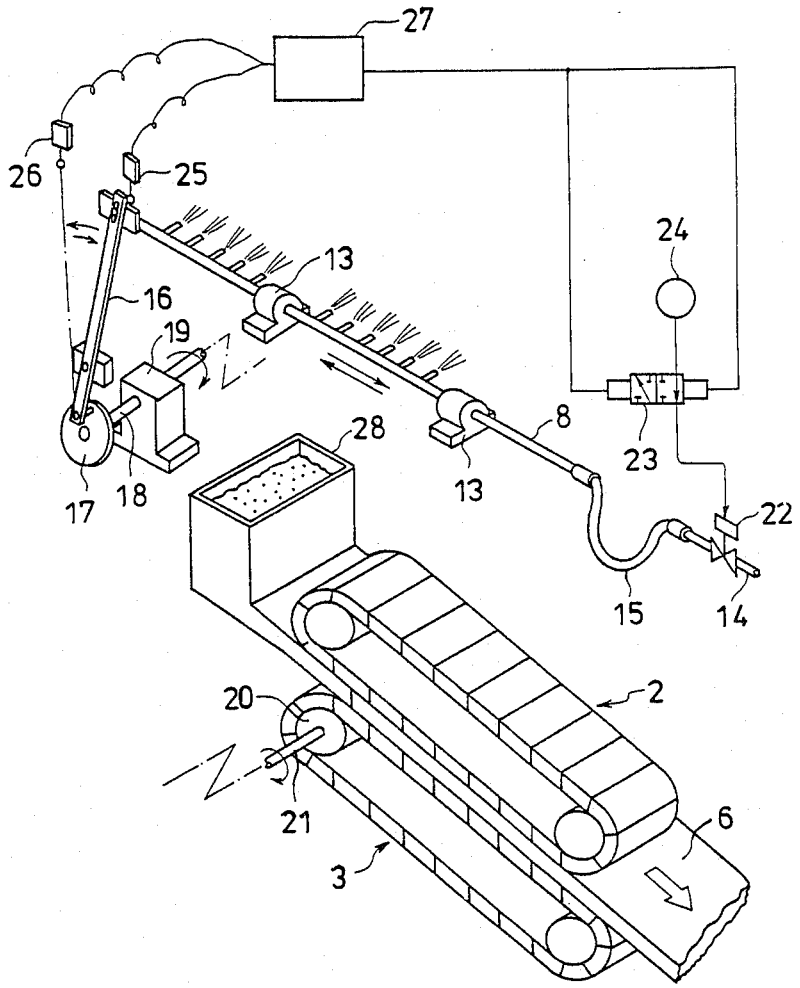
FIG. 3 is a view used to explain a second embodiment of the present invention.

FIG. 3 shows a second embodiment of the present invention. In this embodiment, the cooling water pipe 8 is supported by slide bearings 13 in such a manner that the cooling water pipe 8 can slide in the axial direction thereof. One end of the water cooling pipe 8 is communicated through a flexible hose 15 to a supply pipe 14. The other end of the cooling pipe 8 is connected to the upper end of a lever 16 which is pivotably fixed to a frame (not shown) of the continuous casting machine and whose lower end is pivoted to a cam 17. The rotating shaft 18 of the cam 17 is drivingly coupled through a reduction gear 19 to a rotating shaft 21 of a guide wheel 20 for driving the cooling block chain 2 so that the cam 17 is rotated in synchronism with the rotation of the guide wheel 20 (the movement of each cooling block 1).

Upon rotation of the cam 17, the lever 16 is caused to swing so that the cooling water pipe 8 is caused to reciprocate in the axial direction thereof (that is, the direction of the movement of the cooling blocks 1)

A pneumatically operated cut-off valve 22 is inserted in the supply pipe 14 and is communicated through a solenoid-operated valve 23 to an air source 24. Limit switches 25 and 26 are disposed at respective ends of the swinging stroke of the lever 16 so that whenever the lever 16 reaches one of the ends of its stroke, one of the limit switches 25 and 26 are actuated so that an electrical signal is transmitted from the actuated limit switch 25 or 26 to a controller 27. In response to the electrical signal thus received, the solenoid-operated switch 23 is switched so that the cut-off valve 22 is opened or closed and consequently the flow of the cooling water into the cooling water pipe 8 is started or interrupted.

The reduction ratio and the cam configuration are so determined that the cooling block chain 3 is displaced in the direction of the casting 6 at the same velocity of the cooling water pipe 8 while each nozzle 10 is maintained in line with the corresponding cooling hole 7.

Reference numeral 28 represents a tundish.

Next the mode of operation of the second embodiment with the above-mentioned construction will be described. When the cooling water pipe 8 is driven in the same direction of the flow of the casting 6, the cut-off valve 22 is opened so that it is communicated with the air source 24. As a result, the cooling water flows from the supply pipe 14 and the cooling water pipe 8 and issues through the nozzles 10 into the cooling holes 7. When the water cooling pipe 8 reaches its one end of its stroke, the limit switch 25 is actuated so that the cut-off valve 22 is closed and the cooling water pipe 8 returns to the other end of its stroke while the injection of the cooling water through the nozzles 10 into the cooling holes 7 is kept interrupted. When the cooling water pipe 8 reaches its the other end of its stroke, the limit switch 26 is activated so that the cut-off valve 22 is opened. Then, the cooling water is supplied in the manner discribed above while the cooling water pipe 8 is moved toward its one end of its stroke while injecting the cooling water through the nozzles 10 into the cooling holes 7.

Thus, the cooling water pipe 8 injects the cooling water through the nozzles 10 into the cooling holes 7 only during its going stroke.

Therefore, the cooling water will not impinge on the surfaces of the cooling blocks 1 and be wasted.

Figure 4:
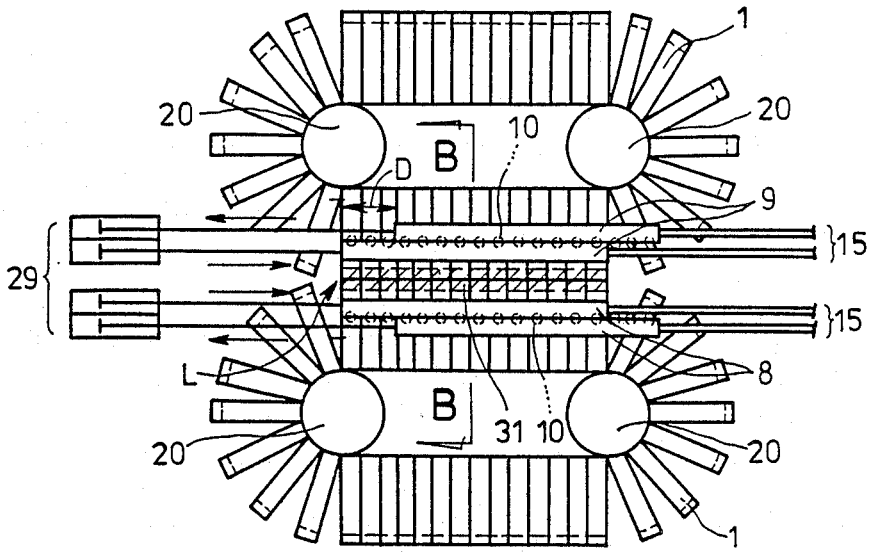
FIG. 4 is also a view to explain a third embodiment of the present invention.
Figure 5:
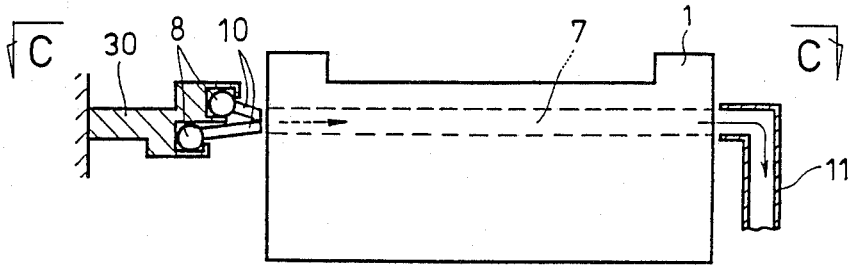
FIG. 5 is a sectional view taken along the line B—B of FIG. 4.
Figure 6:
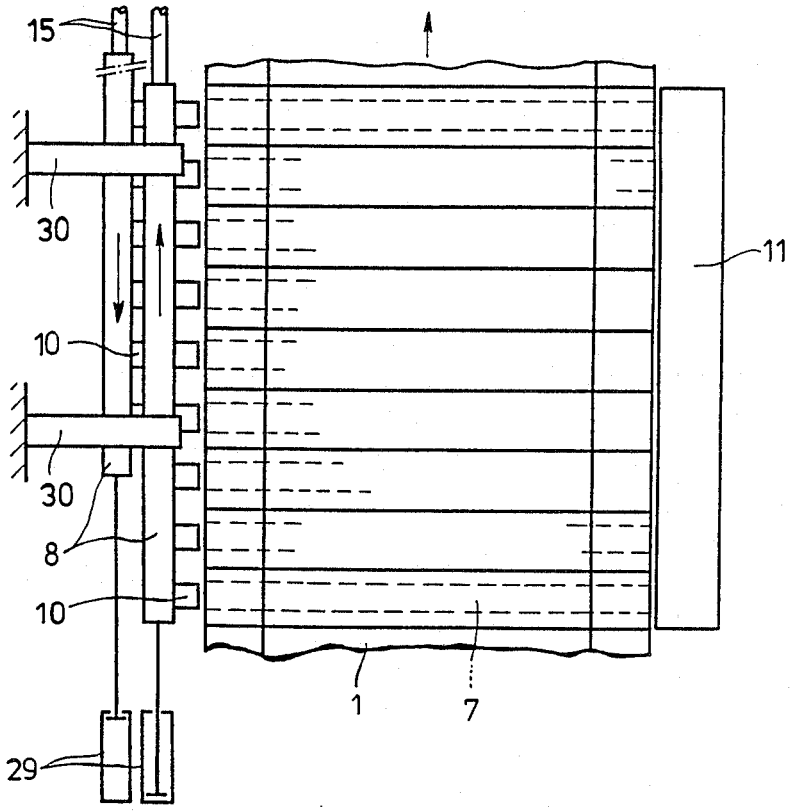
FIG. 6 is a sectional view taken along the line C—C of FIG. 5.
Figure 8:
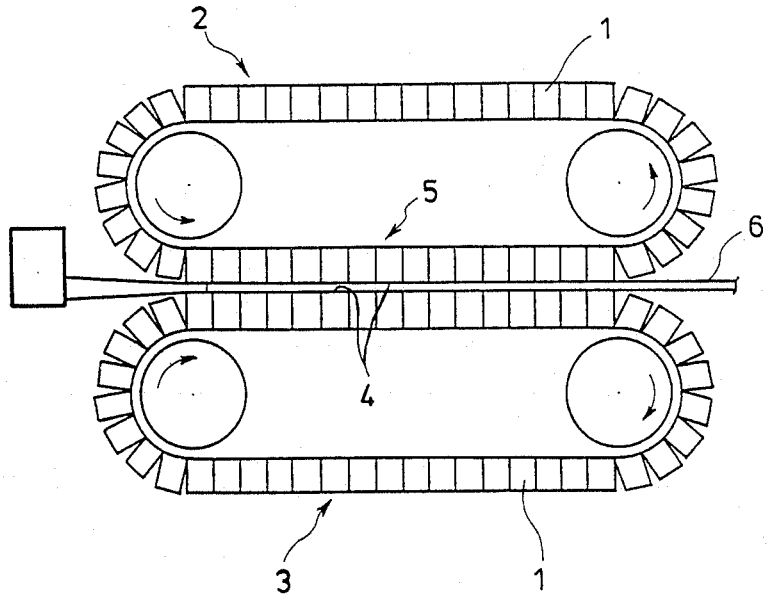
FIG. 8 is a view used to explain a conventional cooling mold apparatus for a continuous casting machine.

FIGS. 4–6 show a third embodiment of the present invention. Two upper water cooling pipes 9 and two lower water cooling pipes 8 are extended in parallel with one side surface defined by the upper and lower cooling block chains and the nozzles 10 of the water cooling pipes 8 and 9 are spaced apart from each other by the same distance between the adjacent cooling holes 7 in each cooling block 1. One ends of the cooling water pipes 8 and 9 are connected to driving devices 29 (such as cylinders as shown in FIG. 4) so that the cooling water pipes 8 and 9 are caused to reciprocate in the line direction so as to repeatedly cool the cooling blocks 1 while the other ends of the cooling water pipes 8 and 9 are communicated with flexible hoses 15 through which the cooling water can be supplied into the cooling water pipes 8 and 9 without interruption. The cooling water pipes 8 and 9 are slidably supported by guides 30 which in turn are securely attached to a frame (not shown).

The cooling water pipes 8 and 9 are substantially same in construction and mode of operation and therefore a description of the lower cooling water pipes 8 will suffice for both.

First the driving device 29 is activated to displace one cooling water pipe 8 toward the upstream side of the line so that the upper stream end of one water cooling pipe 8 becomes in line with the upper stream end of a mold cavity 31. The cooling water pipe 8 is caused to reciprocate over a distance D from the reference line L at which the upper-stream end of the cooling water pipe 8 is in line with the upper-stream end of the mold cavity 31. Thereafter when the cooling blocks 1 are displaced downstream of the line so that the cooling holes 7 and the nozzles 10 are in line with each other, the driving device 29 is activated to displace the cooling pipe 8 in the downstream direction of the line in synchronism with the movement of the cooling blocks 1. Therefore, all the cooling water issued through the nozzles 10 is completely injected into the cooling holes 7 without any leakage. The cooling water flowing through the cooling holes cools the surfaces thereof and then is discharged into the tray 11 through which the cooling water is discharged out of the mold cooling system. After the cooling water pipe 8 has been displaced over the distance D in synchronism with the movement of the cooling blocks 1, the cooling water pipe 8 is returned by the driving device 29.

While said one cooling water pipe 8 is displaced downstream in synchronism with the movement of the cooling blocks 1, the other cooling water pipe 8 is returned from the position spaced apart by a distance D from the reference line L by the driving device 29. In the return stroke, the injection of the cooling water from the other cooling water pipe 8 through the nozzles 10 thereof into the cooling holes 7 of the cooling blocks 1 is interrupted so that the consumption of the cooling water can be reduced to a minimum. The return stroke speed of the cooling water pipe 8 is selected to be equal to or faster than the velocity of the cooling blocks 1. In the latter case, the two cooling water pipes 8 may be switched to move in unison in the downstream direction of the like. Alternatively, the cooling water pipes 8 may be displaced downstream as soon as they are returned to the reference line L.

When the strokes D of the cooling water pipes 8 is made equal to the distance between the adjacent cooling holes 7, the two cooling water pipes 8 are alternately displaced so that the cooling water can be injected into all the cooling holes 7. When it is desired that the cooling effect is increased in the downstream direction of the line, it suffices to determine a longer displacement stroke D of the cooling water pipes 8 and to delay the start of the cooling water injection time in proportion to a time required for the cooling water pipes to be displaced over the distance D. Furthermore the reciprocation stroke D of the cooling water pipes 8 may be suitably selected depending upon the cooling conditions.

Figure 7:
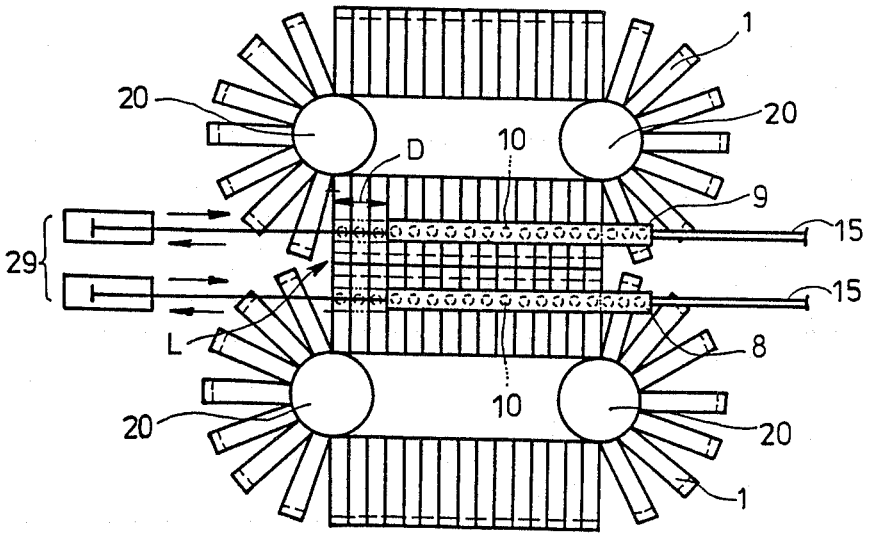
FIG. 7 is a view used to explain a fourth embodiment.

FIG. 7 shows a fourth embodiment of the present invention. In this embodiment, the velocity of the return stroke of the cooling water pipe 8 is increased so that a high degree of cooling effect can be obtained with only one cooling water pipe 8.

As described above, according to the present invention, the cooling blocks in contact with the casting can be water-cooled so that a high degree of heat dissipation effect can be attained, the growth rate of the shell can be increased to increase the casting speed and serious accidents such as break-outs can be prevented by the continuation of the water cooling when the mold apparatus is stopped in the case of an emergency.

What is claimed is:

1. A mold apparatus for an endless track type continuous casting machine of the type in which a plurality of cooling blocks are interconnected with each other in the form of an endless chain so as to assemble a cooling block chain which can define a straight wall; two of said cooling block chains are disposed such that a mold is defined by said straight walls thereof; and said cooling block chains are driven in synchronism with a casting speed or rate, wherein a plurality of cooling holes are formed through each cooling block in the direction of the movement thereof and in parallel with said straight wall surface; cooling water pipes are extended along one side surface of said straight wall; said cooling water pipes are provided with nozzles in line with said cooling holes, respectively; means are provided to forcibly inject the cooling water through said nozzles into respective cooling holes of said cooling blocks which are moved; and means are provided to cause said injection of cooling water only when said nozzles are in line with their respective cooling holes.

2. A mold apparatus as set forth in claim 1 wherein said cooling water pipes are caused to reciprocate in synchronism with the velocity of the movement of said cooling blocks.

3. A mold apparatus as set forth in claim 1 wherein two cooling water pipes are extended along one side surface of said straight wall of each of the cooling block chains such that said two cooling water pipes are caused to reciprocate alternately.

4. A mold apparatus as set forth in claim 2 wherein the velocity of the return stroke of the reciprocal movement of each of said cooling water pipes is selected faster than the velocity of the going stroke.

5. A mold apparatus as set forth in claim 2 wherein said cooling water pipes are reciprocated by means of cylinders.

6. A mold apparatus as set forth in claim 2 wherein each of said cooling water pipes are reciprocated by a mechanism consisting of a cam and a lever.

* * * * *

UNITED STATES PATENT AND TRADEMARK OFFICE

CERTIFICATE OF CORRECTION

PATENT NO. : 4,807,692

DATED : February 28, 1989

INVENTOR(S) : Yutaka Tsuchida et al.

It is certified that error appears in the above-identified patent and that said Letters Patent is hereby corrected as shown below:

Claim 4, line 1, after "claim 2"
should be inserted --or 3--

Claim 5, line 1, after "claim 2"
should be inserted --or 3--

Claim 6, line 1, after "claim 2"
should be inserted --or 3--

Signed and Sealed this

Fourteenth Day of November, 1989

*Attest:*

JEFFREY M. SAMUELS

*Attesting Officer* *Acting Commissioner of Patents and Trademarks*